US012780375B2

(12) United States Patent
Shiue

(10) Patent No.: US 12,780,375 B2
(45) Date of Patent: Nov. 3, 2026

(54) BOUBLE-LENS BREATHABLE MASK

(71) Applicant: QBAS Co., Ltd., Taipei City (TW)

(72) Inventor: Chih-Cheng Shiue, Taipei City (TW)

(73) Assignee: QBAS CO., LTD., Taipei City (TW)

( * ) Notice: Subject to any disclaimer, the term of this patent is extended or adjusted under 35 U.S.C. 154(b) by 606 days.

(21) Appl. No.: 18/341,342

(22) Filed: Jun. 26, 2023

(65) Prior Publication Data

US 2023/0415865 A1 Dec. 28, 2023

Related U.S. Application Data

(60) Provisional application No. 63/404,013, filed on Sep. 6, 2022, provisional application No. 63/356,230, filed on Jun. 28, 2022.

(51) Int. Cl.
*B63C 11/16* (2006.01)
*B63C 11/12* (2006.01)

(52) U.S. Cl.
CPC ..... *B63C 11/16* (2013.01); *B63C 2011/126* (2013.01)

(58) Field of Classification Search
CPC ..... B63C 2011/126
See application file for complete search history.

(56) References Cited

U.S. PATENT DOCUMENTS 6,668,823 B1 * 12/2003 Liu ..... B63C 11/16 128/201.27
2002/0129818 A1 * 9/2002 Morgan ..... A62B 18/08 128/206.28
2005/0051164 A1 * 3/2005 Hutter ..... B63C 11/16 128/201.11
2016/0271454 A1 * 9/2016 Lo ..... A63B 33/002
2017/0334531 A1 * 11/2017 Shiue ..... H04N 23/54
2018/0319471 A1 * 11/2018 Thomas ..... B63C 11/205
2019/0358496 A1 * 11/2019 Shiue ..... A63B 33/002
2020/0115015 A1 4/2020 Sang

FOREIGN PATENT DOCUMENTS

CN 208683078 U 4/2019
CN 111846162 A * 10/2020 ..... B63C 11/16
TW M609201 U 3/2021

* cited by examiner

*Primary Examiner* — Brandy S Lee
*Assistant Examiner* — Mishal Zahra Hussain
(74) *Attorney, Agent, or Firm* — MUNCY, GEISSLER, OLDS & LOWE, P.C.

(57) ABSTRACT

A double-lens breathing mask includes a breathing tube and a body. The body includes a lens frame assembly, two lenses, and a waterproof sealing skirt. The skirt includes an eye skirt portion, a mouth skirt portion, and a nose skirt portion in between, wherein the eye skirt portion and two lenses are embedded in the lens frame assembly, and the nose skirt portion is formed between the two lenses, and protruding forward from a lower portion of the lens frame assembly. When a user puts on the mask, the two lenses only respectively correspond to eyes of the user, and the nose skirt portion and the mouth skirt portion correspond to nose and mouth of the user, respectively.

11 Claims, 6 Drawing Sheets

BOUBLE-LENS BREATHABLE MASK

CROSS-REFERENCES TO RELATED APPLICATIONS

This patent application claims the benefits of U.S. Prov. Ser. Nos. 63/356,230 filed on Jun. 28, 2022 and 63/404,013 filed on Sep. 6, 2022. Both of the above applications are incorporated herein by reference in their entireties.

BACKGROUND OF THE INVENTION

Field of the Invention

The present invention relates to a breathable mask, particularly a snorkeling breathable mask having a separate left and right lens.

Descriptions of the Related Art

In the traditional diving mask that only covers the user's eyes and nose, because the inside of the mask is airtight, it can be freely designed as a "single-lens type (that is, the left and right lenses are combined into a whole piece of transparent lens)" or "double-lens type (that is, the left and right lenses are independent of each other)". In the commercial market, to some extent, the "double-lens type" is more advantageous than the "single-lens type" to some extent, mainly because of the following reason.

(1) The bridge of the user's nose is more protruding than the eyes (especially the face shape of Westerners). The mask of "double-lens type" does not require a bridging lens, so geometrically, the two separate lenses can be closer to the user's eyes. In other words, the bridge of the frame can be designed forward. The lenses that are closer to the eyes can increase the user's field of vision, which also means that under the same field of view, the lenses can be designed to be smaller, and the overall mask can be designed to be smaller and lighter as well.

(2) The mask of "double-lens type" does not require a bridging lens, therefore the lens area is reduced, and the volume and weight of the entire mask can be reduced as well, especially when tempered glass is used for making the lens.

(3) As opposed to "double-lens type", in the mask of "single-lens type", if the height of bridging lens is designed too large, it will squeeze the design space of the lower area of the nose bridge, and if the height of bridging lens is designed too small, the lens is easy to be broken, and its thickness must be increased, which will cause the problems of design.

(4) In the mask of "double-lens type", because there is no need for setting the bridging lens, the left and right frames can be bridged in a softer way, or pivoted with each other that can be folded in half when not in use, making it more convenient to carry.

(5) In the mask of "double-lens type", because the area of each lens becomes smaller, the risk of lens breakage is reduced, and the processing procedures, such as electroplating, anti-fog coating, lens strengthening, etc., become more economical and easier.

(6) In the mask of "double-lens type", because the lenses are separated, it is possible to install corrective lenses sold on the market to solve the problems of near-sightedness and hyperopia. This way, the frame, lens and waterproof sealing skirt can be easily designed to be detachable, which, however, is not recommended for the mask of "single lens type", because the width of the entire frame of the "single lens type" is larger and thinner, it is easy to break and damage during disassembling, and it is not easy to assemble.

At present, the full-face snorkeling mask (FFSM) uses a large, single-lens design that fully covers the face (including the user's eyes, nose, and mouth). There is not possible to make an FFSM using a "double-lens type" and covering the user's left and right eyes respectively within a limited range of lens. Therefore, in order to break through the current predicament, it is necessary to research and develop in this direction.

SUMMARY OF THE INVENTION

One objective of the present invention is to provide a breathable mask for snorkeling, in which the lens frame only covers the eyes of the user, and no longer extends downwards to cover the user's nose and mouth. The lens embedded in the lens frame are arranged to be a type of left and right independent lenses, which are respectively used as external viewing windows for the user's left and right eyes, while the user's nose and mouth are covered by other mechanisms such as a waterproof sealing skirt. Based on the structure of separating the left and right lenses, the center of the lens frame assembly can be designed more forward, and the lenses themselves can be designed more backward (that is, closer in a direction to the user's eyes). This way, because the lenses are closer to the user's face, the protruding nose skirt portion can be easily designed to be closer to the user's nose and follow the contour of the nose, and as well, it is easier for the user to operate the equalization by pinching his/her nose. In addition, also because the lenses are closer to the user's face, the internal volume of the body of the mask becomes smaller, which enhances the chances to be much lower than the user's tidal volume, and is easier to form a transient negative pressure space, making the external fresh air more inclined to enter the mask. It is no different from greatly reducing the burden on the user's breathing.

In order to achieve the above objective, the present invention provides a double-lens breathable mask comprising a breathing tube having an upper end portion and a lower end portion opposite the upper end portion, and a body connected to the lower end portion of the breathing tube. The body has an interior being in fluid communication with an outside through the upper end portion of the breathing tube. The body includes a lens frame assembly, two lenses and a waterproof sealing skirt being suitable for fitting on a face of a user along a rear edge thereof. The waterproof sealing skirt includes an eye skirt portion, a mouth skirt portion and a nose skirt portion formed between the eye skirt portion and the mouth skirt portion, wherein the eye skirt portion and the two lenses are jointly embedded in the lens frame assembly. The mouth skirt portion has a drain hole and a drain valve formed on the drain hole. The nose skirt portion protruding forward from a lower portion of the lens frame assembly and being between the two lenses. A fastening device fixed to two outer sides of the lens frame assembly or of the eye skirt portion for fastening the body to a head of the user. When the user puts on the double-lens breathable mask, the two lenses are located to only correspond to two eyes of the user, respectively, whereas the nose skirt portion and the mouth skirt portion corresponds to a nose and a mouth of the user, respectively.

Another objective of the present invention is to provide a double-lens breathable mask, in which the breathing tube and the interior of the body are in fluid communication with each other. In order to avoid insufficient rigidity of the connection between the breathing tube and the body, a connector can be disposed between a top of the waterproof sealing skirt and the lower portion of the breathing tube, and a collar can be provided on a top pf the lens frame assembly to hold the connector, so that to reduce the movement of the breathing tube relative to the body.

In order to achieve the above objective, the present invention provides a double-lens breathable mask, wherein the lens frame assembly is hard and includes two lens frames and a bridge connecting the two lens frames. The eye skirt portion is flexibly soft and includes two eye rims which are embedded in the two lens frames together with the two lenses, respectively. The bridge protrudes forward relative to the two lens frames. The waterproof sealing skirt has a top end which is integrally formed with a head, which communicates with the lower end portion of the breathing tube. The double-lens breathable mask further comprises a connector and a collar, wherein the connector is coupled between the head and the lower end portion of the breathing tube, and the collar extends from a top end of the lens frame assembly to hold the head. The connector has two sides each provided with a hold-down, which is suitable for fastening on the collar to strengthen a connection among the breathing tube, the lens frame assembly and the waterproof sealing skirts.

DESCRIPTION OF THE PREFERRED EMBODIMENT

Figure 1:
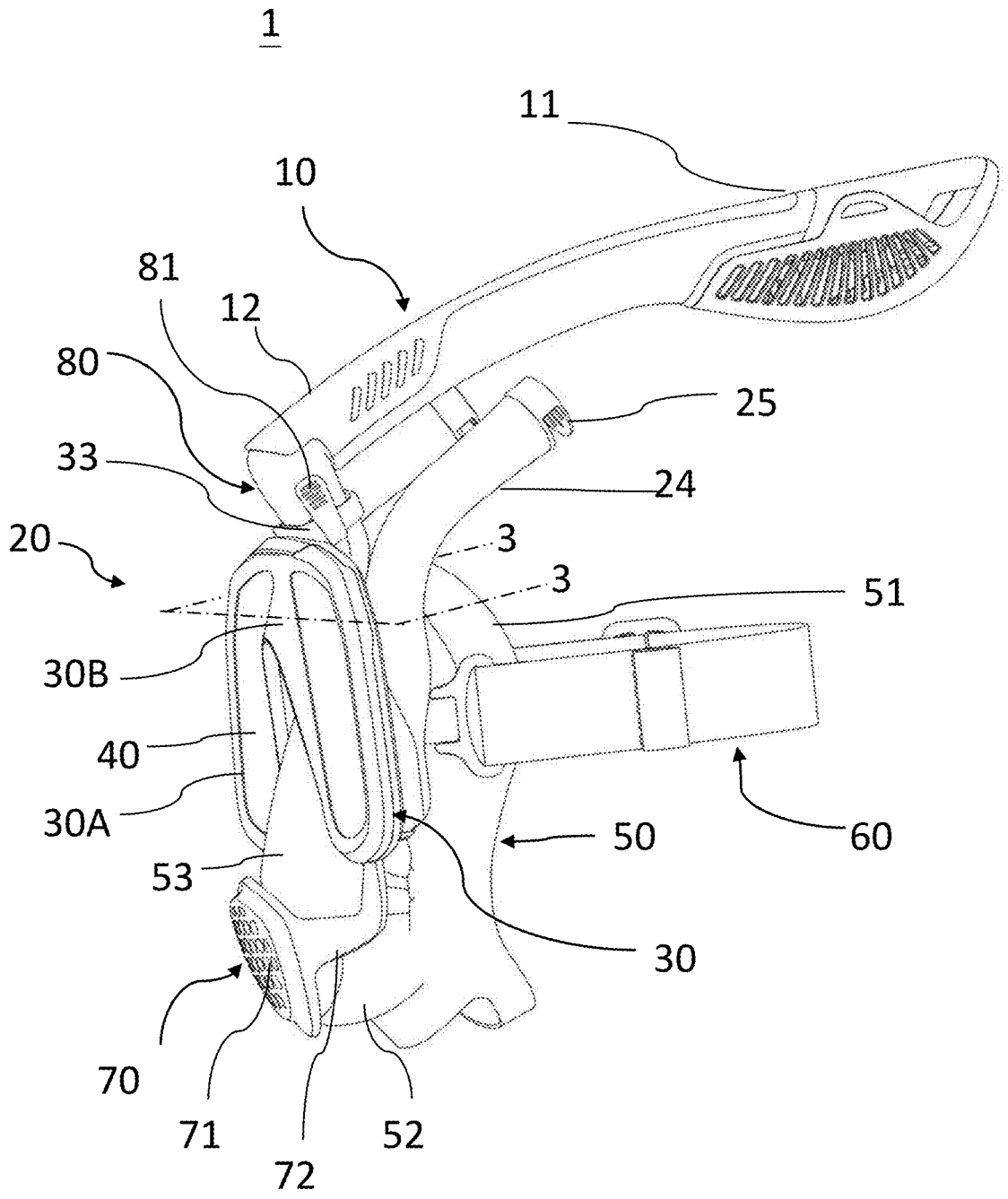
FIG. 1 is a side perspective view of an embodiment of the present invention.
Figure 2:
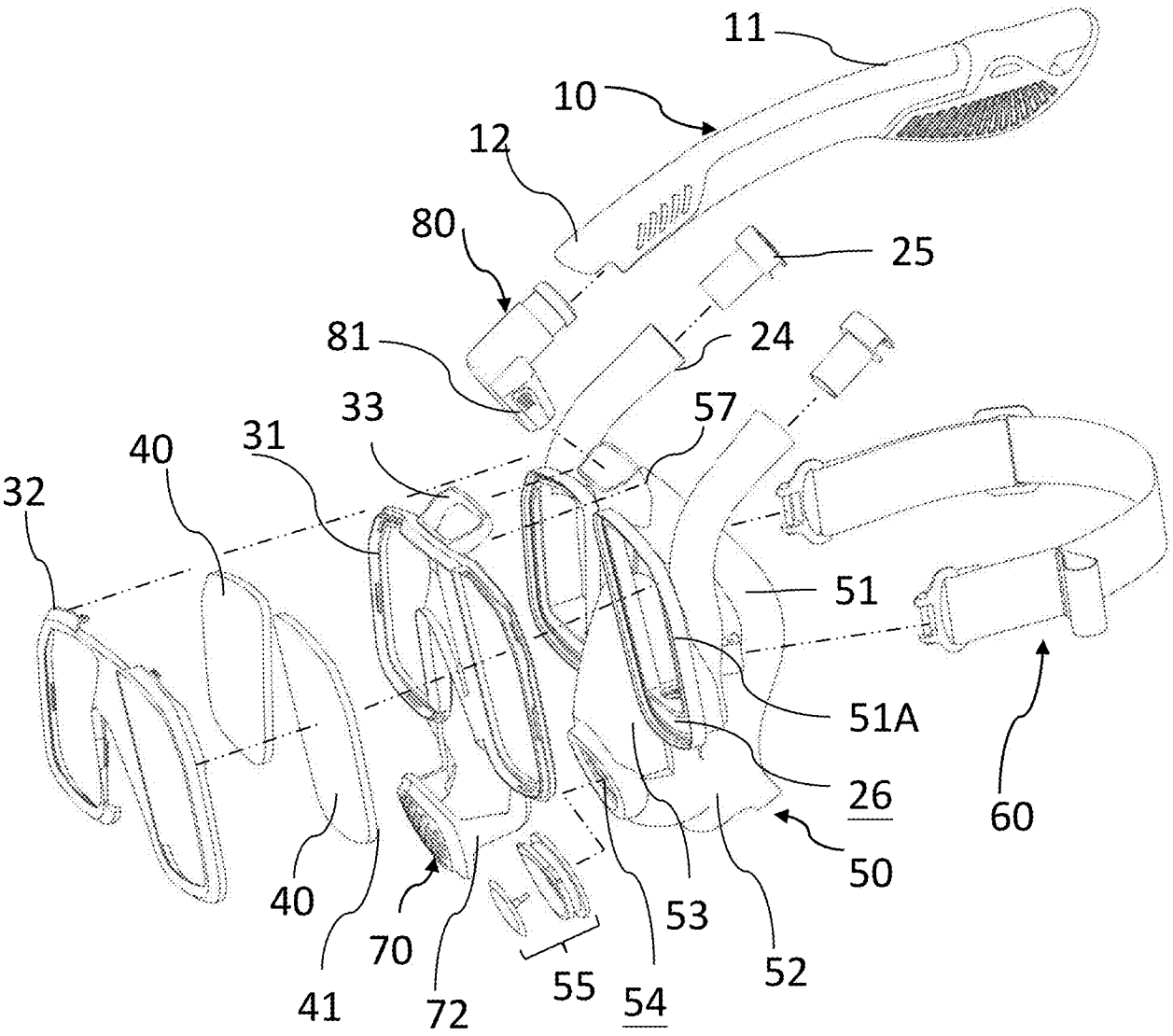
FIG. 2 is an exploded view of FIG. 1.

Referring to FIG. 1 and FIG. 2, a double-lens breathable mask 1 which can cover the whole face of the user, so that the user can breathe in the mask through his/her nose and/or mouth while snorkeling. The double-lens breathing mask 1 includes a breathing tube 10 and a body 20. The breathing tube 10 has an upper end portion 11 and a lower end portion 12 opposite to the upper end portion 11. The body 20 is connected to the lower end portion 12 of the breathing tube 10, and an interior of the body 20 is in fluid communication with the outside through the upper end portion 11 of the breathing tube 10. The body 20 includes a lens frame assembly 30, two lenses 40 (i.e., a left lens and a right lens) and a waterproof sealing skirt 50. The rear edge of the waterproof sealing skirt 50 is adapted to fit a user's face. The waterproof sealing skirt 50 comprises an eye skirt portion 51, a mouth skirt portion 52 and a nose skirt portion 53 between the eye skirt portion 51 and the mouth skirt portion 52, wherein the eye skirt portion 51 and the two lenses 40 are embedded together in the lens frame assembly 30. Preferably, as shown in FIG. 2, the eye skirt portion 51, the mouth skirt portion 52 and the nose skirt portion 53 are integrally formed of soft silicone. The lens frame assembly 30 includes a main frame 31 and a sub frame 32. During assembly, the eye skirt portion 51, the main frame 31, the lenses 40 and the sub-frame 32 are sequentially connected and fixed from the inside to the outside. They can also be made detachable, which is convenient for users to replace the lenses 40, such as lenses for correcting nearsightedness and hyperopia, electroplated lenses, anti-ultraviolet lenses, etc. Or, it is convenient for users to replace the main frame 31 and sub-frame 32 of different colors and styles, adding more fun.

The mouth skirt portion 52 has a drain hole 54, and a one-way drain valve 55 disposed on the drain hole 54. The nose skirt portion 53 protrudes forward from the lower portion of the lens frame assembly 30 at a place between the two lenses 40. A fastening device 60 is fixed to the two outer sides of the lens frame assembly 30 or the eye skirt portion 51 of the body 20 for fastening the body 20 to a user's head (not shown). When a user puts on the double-lens breathing mask 1, the two lenses 40 are only suitable for corresponding to the eyes of the user, whereas the nose skirt portion 53 and the mouth skirt portion 52 are suitable for substantially corresponding to the user's nose and mouth, respectively.

Figure 3:
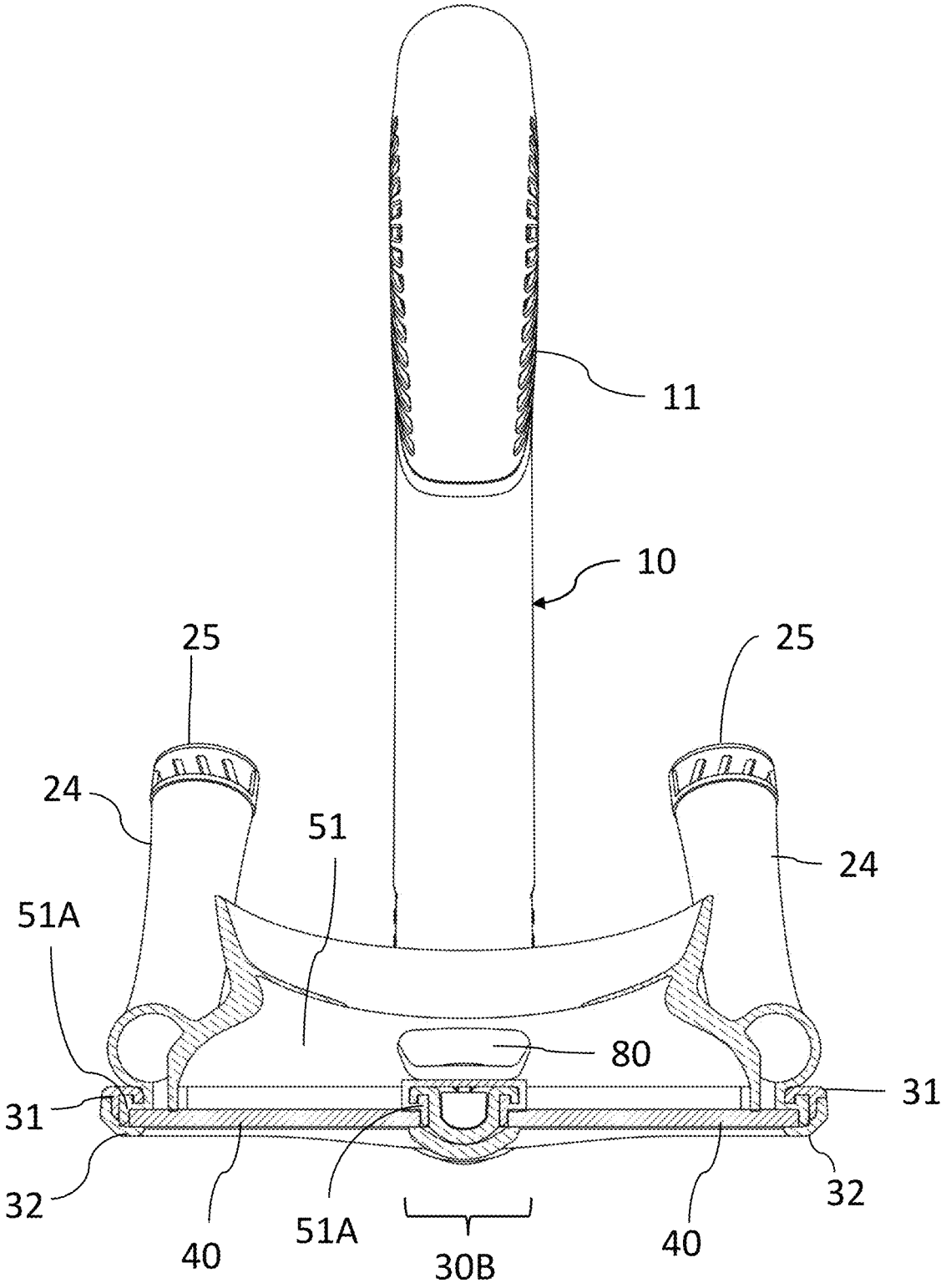
FIG. 3 is a transverse cross-sectional view along line 3-3 of FIG. 1.

Further in reference to FIG. 3, preferably, the lens frame assembly 30 that can include the main frame 31 and the sub-frame 32 is hard, and includes two lens frames 30A and a bridge 30B connecting the two lens frames 30A. The eye skirt portion 51 is flexibly soft and includes two eye rims 51A. The two eye rims 51A of the eye skirt portion 51 and the two lenses 40 are embedded in the two lens frames 30A of the lens frame assembly 30, respectively. The bridge 30B protrudes forward relative to the two lens frames 30A. This way, the lenses 40 can be designed inwardly to be closer in a direction to the eyes of the user.

Figure 4:
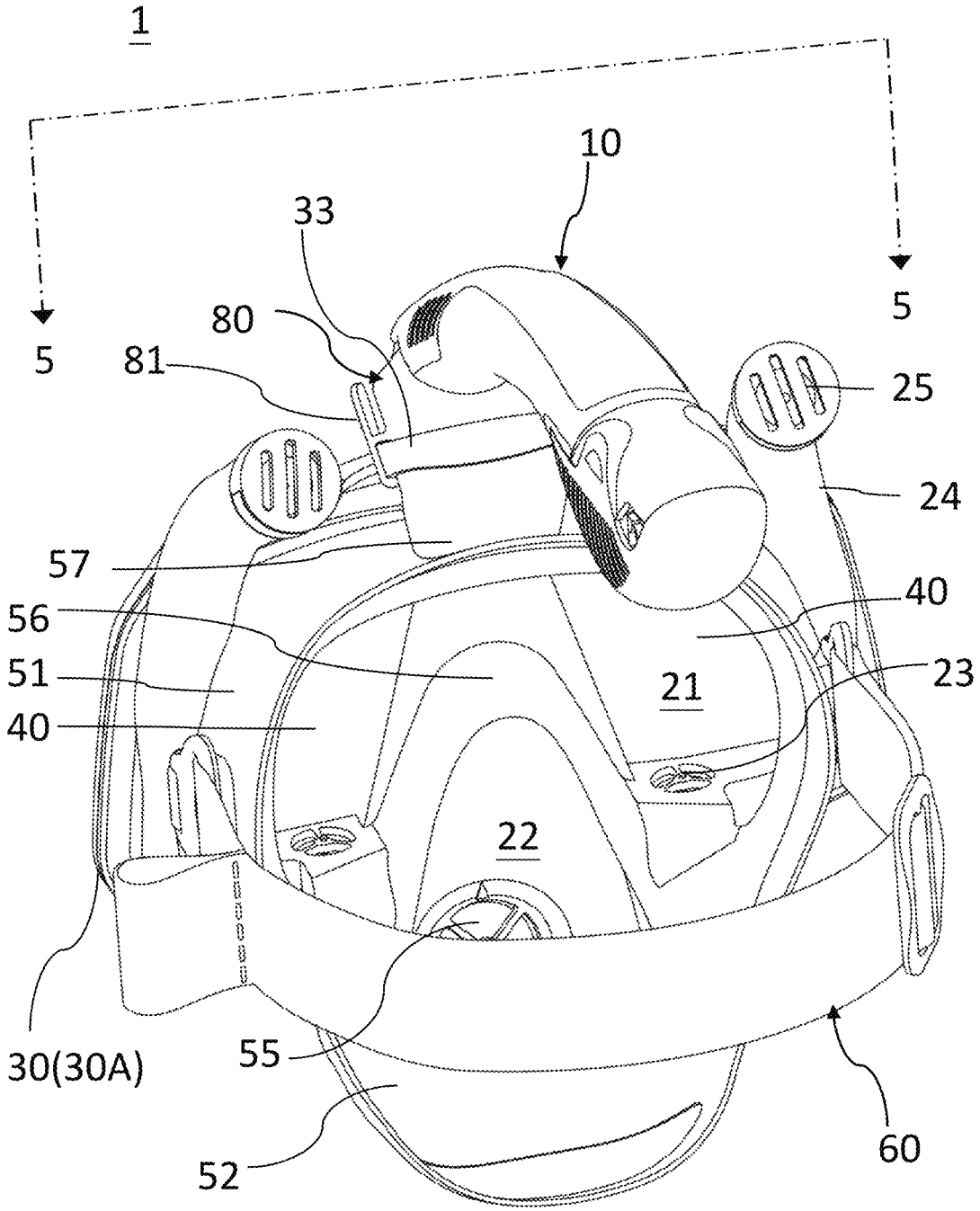
FIG. 4 is a rear perspective view of FIG. 1.

The following is a description of a preferred way for the breathing tube 10 to be firmly assembled on the body 20. Referring to FIG. 2 and FIG. 4, the top end of the waterproof sealing skirt 50 is integrally formed with a head 57 connecting and communicating with the lower end portion 12 of the breathing tube 10. Preferably, the double-lens breathing mask 1 further comprises a connector 80 and a collar 33, wherein the connector 80 is in watertight coupled between the head 57 and the lower end portion 12 of the breathing tube 10, and the collar 33 extending from the top of the lens frame assembly 30 fits over and firmly holds the connector 80. The two sides of the connector 80 each are provided with a hold-down 81 suitable for buckling on the collar 33 to strengthen the connection among the breathing tube 10, the lens frame assembly 30 and the waterproof sealing skirt 50.

Referring back to FIG. 1 and FIG. 2 again, the double-lens breathing mask 1 further includes a cover 70, which is fixed on the outside of the drain valve 55, and the cover is formed with a plurality of small holes 71 for supplying dirty air exhaled from the user's mouth and/or water accumulated in the body 20 to discharge outside from the drain valve 55 through the plurality of small holes 71. Moreover, the cover 70 has two brackets 72, each arranged on an outer side of the area where the nose skirt portion 53 and the mouth skirt portion 52 are located. The two brackets 72 are connected to the lens frame assembly 30.

With reference to FIG. 4, the nose skirt portion 53 is formed with a partition 56 extending backward between the two lens frames 30A, which is suitable for dividing the interior of the body 20 into an upper chamber 21 corresponding to the eye skirt portion 51, and a lower chamber 22 corresponding to the nose skirt portion 53 and the mouth skirt portion 52, so that when the user puts on the double-lens breathing mask 1, the upper portion of the partition 56 is properly seated on the user's nose, and the user's eyes are accommodated in the upper chamber 21, whereas the user's nose and mouth are accommodated in the lower chamber 22.

Figure 5A:
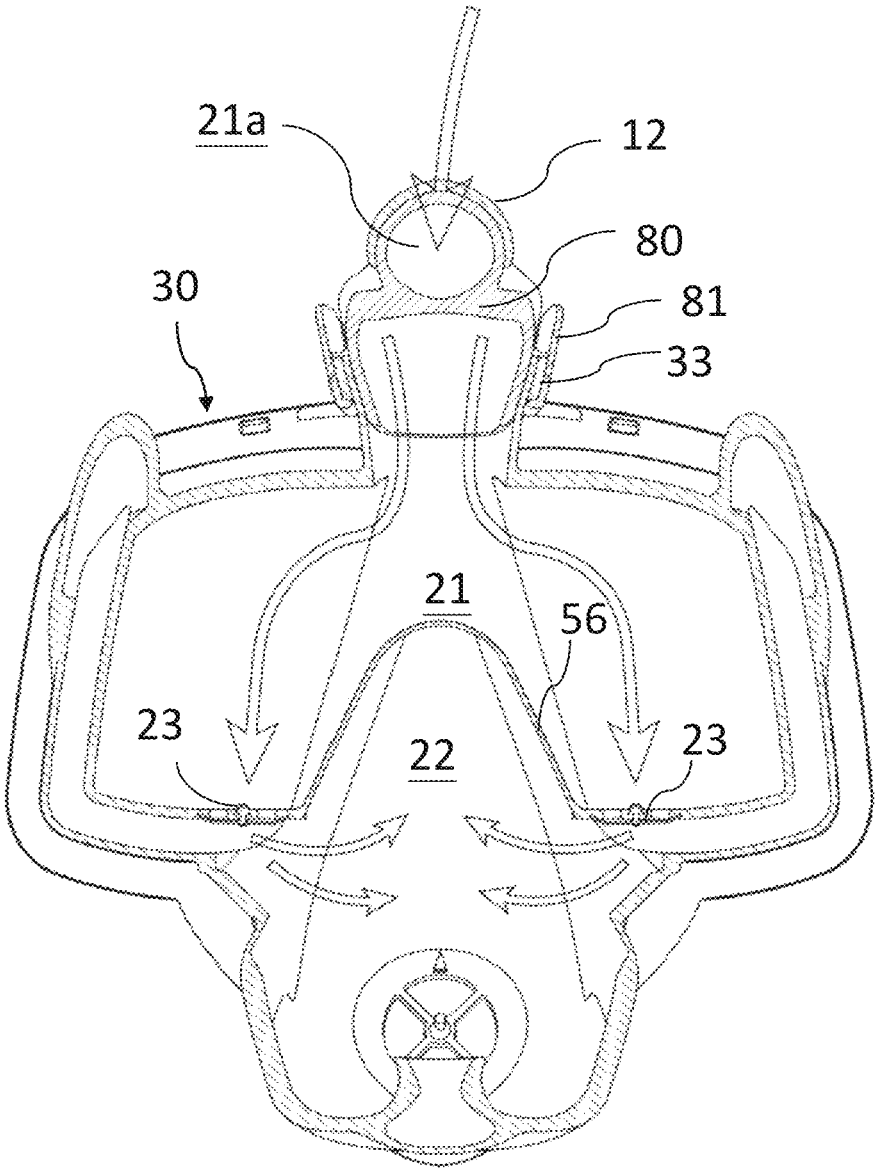
FIG. 5A is a coronal sectional view along line 5-5 of FIG. 4, showing the intake airflow.
Figure 5B:
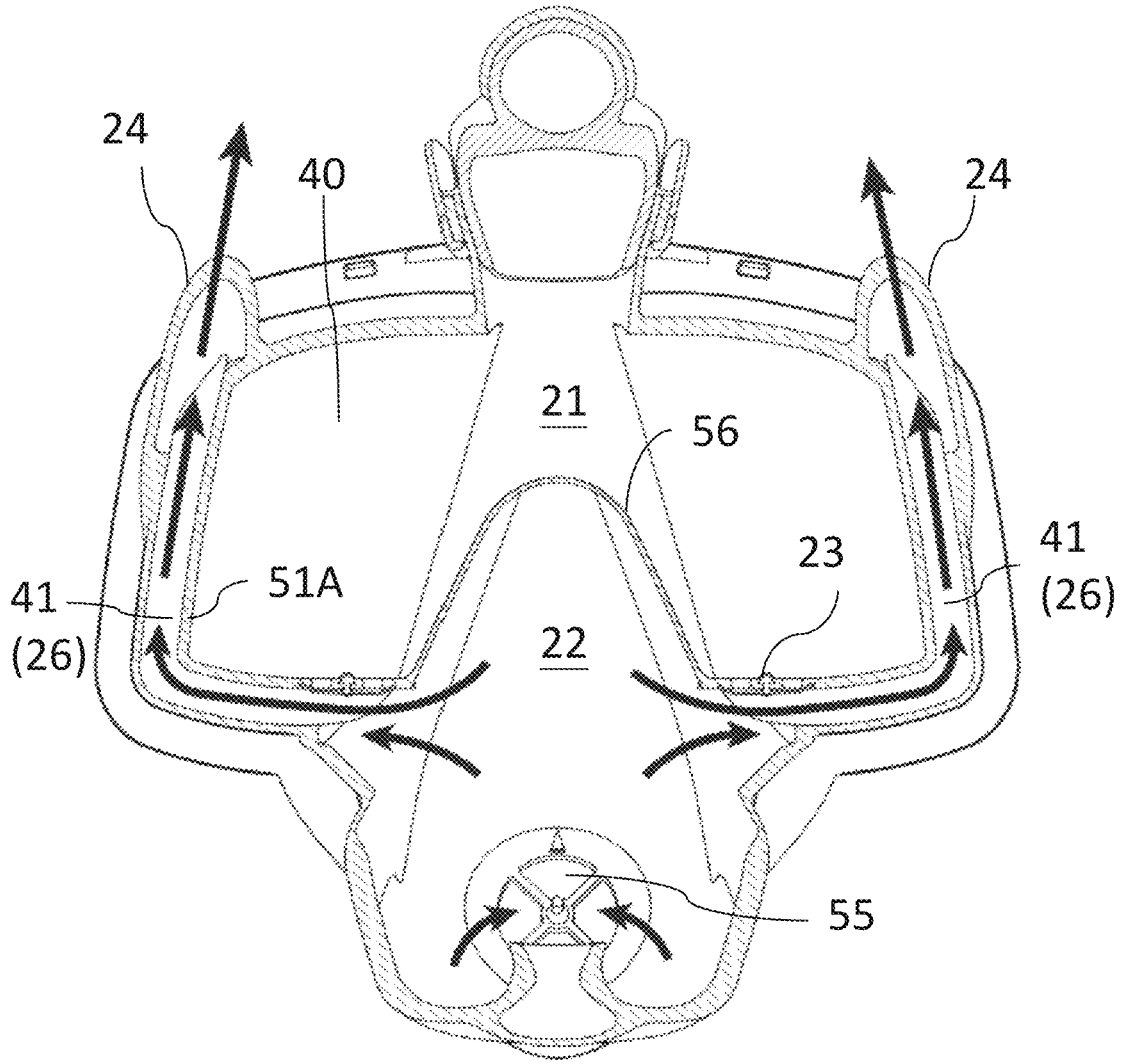
FIG. 5B is a coronal cross-sectional view along line 5-5 of FIG. 4, showing the exhaust airflow.

As shown in FIG. 5A, the body 20 further includes an intake passage 21*a* and an intake one-way valve 23, formed between the lower end portion 12 of the breathing tube 10 and the lower chamber 22, for the fresh air exhaled from the breathing tube to unidirectionally flow into the lower chamber 22, wherein the intake one-way valve 23 lies, i.e., is horizontally disposed, on an outer side of the partition 56. As shown in FIGS. 4 and 5B, the body 20 further includes an exhaust conduit 24 and an exhaust one-way valve 25. Specifically, the exhaust conduit 24 extends upward from an outer side of the eye skirt portion 51 and is in fluid communication with the lower chamber 22. Preferably, the exhaust one-way valve 25 is located at the top of the exhaust conduit 24, for a part of the dirty air exhaled from the user to unidirectionally pass from the lower chamber 22, through the exhaust conduit 24 and the exhaust one-way valve 25, and then to discharge outside. More preferably, a lower, outer side of the eye skirt portion 51, and a peripheral inner surface 41 of one of the lenses 40 jointly form an exhaust tunnel 26 which, along one of the eye rims 51A, is located between and communicates the lower chamber 22 and the exhaust conduit 24. Therefore, a part of the dirty air exhaled from the user may enter the exhaust tunnel 26 from the lower chamber 22, then pass through the exhaust conduit 24 and the exhaust one-way valve 25, and finally discharged outside unidirectionally, whereas the other part of the dirty air will be exhausted through from the drain valve 55 and the small hole 71 formed on the cover 70, thereby draining out together with the water leaked in and accumulated in the lower chamber 22 of body 20.

More preferably, the exhaust conduit 24 extends upwards and backwards from the outer side of the eye skirt portion 51, being generally in line with the extension direction of the breathing tube 10, so that when the user faces down during underwater snorkeling, there will be more chances to allow that the top of each of the breathing tube 10 and the exhaust conduits 24 can be easily exposed out of the water surface, thereby increasing the smoothness of the user's breathing.

The main feature of the present invention is that the novel full-face mask adopts a double-lens design that only covers the user's eyes and the lenses are separated from each other. Therefore, any full-face mask that does not deviate from this design concept, such as the structure listed below that is different from the exemplified structure of the above embodiments, should be protected by the content as the claims set forth:

(1) In terms of the design of the intake and exhaust paths: a breathing tube having plural ducts inside, e.g., a central intake duct and two side exhaust ducts can be used; or a breathing tube only having an intake duct inside, and the separate exhaust duct(s) not shared with the breathing tube can be used instead. The above embodiment only describes one of them. The other non-tube sharing alternatives, such as using a single side of the short exhaust conduit, or even using no exhaust conduit at all by directly set the exhaust exits on the top of the body, are also feasible.

(2) In terms of the design of the intake one-way valve: the position of the intake one-way valve can be symmetrically arranged on both sides of the partition, or other positions, such as the top of the partition. The form of the intake one-way valve can be a traditional central fixed type (such as a mushroom type) or a unilateral fixed type (such as a pivotal type).

(3) The element mentioned in the claims, such as the passage and the one-way valve, are described in a single quantity, which is to clearly define the relationship among elements, and does not mean to limit their quantities.

The invention claimed is:

1. A double-lens breathable mask comprising:

a breathing tube having an upper end portion and a lower end portion opposite the upper end portion; the breathing tube only having an intake duct inside;

a body connected to the lower end portion of the breathing tube, and the body having an interior being in fluid communication with an outside through the upper end portion of the breathing tube; the body includes:

a lens frame assembly which is hard, and includes two lens frames and a bridge connecting the two lens frames, in which the bridge protrudes forward relative to the two lens frames;

two lenses;

a waterproof sealing skirt, being suitable for fitting on a face of a user along a rear edge thereof; the waterproof sealing skirt including an eye skirt portion, a mouth skirt portion, and a nose skirt portion formed between the eye skirt portion and the mouth skirt portion, wherein the eye skirt portion and the two lenses are jointly embedded in the lens frame assembly; the mouth skirt portion has a drain hole, and a drain valve formed on the drain hole; and the nose skirt portion protrudes forward from a lower portion of the lens frame assembly and is placed between the two lenses; wherein the nose skirt portion is formed with a partition extending backward between the two lens frames and dividing the interior of the body into an upper chamber corresponding to the eye skirt portion and a lower portion corresponding to the nose skirt portion and the mouth skirt portion;

an intake passage and an intake one-way valve, both formed between the lower end portion of the breathing tube and the lower chamber, whereby inhaled fresh air is capable of unidirectionally flowing from the breathing tube into the lower chamber;

an exhaust tunnel communicating the lower chamber; the exhaust tunnel jointly defined by a lower, outer side of the eye skirt portion, and a peripheral inner surface of one of the lenses;

a fastening device fixed to two outer sides of the lens frame assembly or of the eye skirt portion for fastening the body to a head of the user;

when the user puts on the double-lens breathable mask, the partition rests on a nose of the user; whereby two eyes of the user are accommodated in the upper chamber, and the two lenses are located to only correspond to the two eyes of the user, respectively, whereas the nose and a mouth of the user are accommodated in the lower chamber, and the nose skirt portion and the mouth skirt portion corresponds to the nose and the mouth of the user, respectively.

2. The double-lens breathable mask according to claim 1, wherein the eye skirt portion is soft and includes two eye rims which are embedded in the two lens frames together with the two lenses, respectively.

3. The double-lens breathable mask according to claim 2, wherein the waterproof sealing skirt has a top end which is integrally formed with a head, which communicates with the lower end portion of the breathing tube.

4. The double-lens breathable mask according to claim 3, further comprising a connector and a collar, wherein the connector is coupled between the head and the lower end portion of the breathing tube, and the collar extends from a top end of the lens frame assembly to hold the head.

5. The double-lens breathing mask according to claim 4, wherein the connector has two sides each provided with a hold-down, which is suitable for fastening on the collar to strengthen a connection among the breathing tube, the lens frame assembly and the waterproof sealing skirts.

6. The double-lens breathable mask according to claim 1, further comprising a cover, which is fixed on an outside of the drain valve, and a plurality of small holes are formed on the cover to provide dirty air or accumulated water in the body to be discharged therethrough from the drain valve.

7. The double-lens breathable mask according to claim 6, wherein the cover has two brackets, each arranged on an outer side of an area where the nose skirt portion and the mouth skirt portion are located, and are connected to the lens frame assembly.

8. The double-lens breathable mask according to claim 2, wherein the body further includes:

an exhaust conduit and an exhaust one-way valve, in which the exhaust conduit extends upward from one outer side of the eye skirt portion and is in fluid communication with the lower chamber, and the exhaust one-way valve is arranged on a top portion of the exhaust conduit, whereby a part of dirty air exhaled from the user is capable of discharging outside unidirectionally from the lower chamber, through the exhaust conduit and the exhaust one-way valve.

9. The double-lens breathable mask according to claim 8, wherein the intake one-way valve lies on an outer side of the partition.

10. The double-lens breathable mask according to claim 9, wherein the exhaust tunnel is located between the lower chamber and the exhaust conduit.

11. The double-lens breathable mask according to claim 10, wherein the exhaust conduit extends upward from the outer side of the eye skirt portion and then extends backward.

* * * * *